United States Patent [19]

Knudson

[11] 4,364,253

[45] Dec. 21, 1982

[54] PANEL FORMING APPARATUS

[76] Inventor: Gary A. Knudson, 17356 W. 57th Ave., Golden, Colo. 80401

[21] Appl. No.: 236,832

[22] Filed: Feb. 23, 1981

[51] Int. Cl.[3] ..... B21D 47/00

[52] U.S. Cl. ..... 72/187; 72/181; 72/234; 72/442

[58] Field of Search ..... 52/86, 87, 528, 536, 52/537, 538, 630, 585; 72/181, 187, 234, 442, 444

[56] References Cited

U.S. PATENT DOCUMENTS 3,006,224 10/1961 Celovsky ..... 72/234

3,518,859 7/1970 Brinkeborn et al. ..... 72/442

*Primary Examiner*—Lowell A. Larson

*Attorney, Agent, or Firm*—Ancel W. Lewis, Jr.

[57] ABSTRACT

A novel panel and panel assembly for use in building-type structures, together with panel forming apparatus are disclosed which are especially suitable for using portable, point-of-use, continuously operable, roll-forming techniques. The panel is characterized by upwardly diverging inclined sidewall portions (26, 27), wing portions (28, 29) of substantial lateral extent in relation to an intermediate wall portion that forms the bottom thereof, and centered edge fastening structure (31, 32). This panel provides a greater panel width per sheet stock width, ease of assembly, spacing and tracking surfaces for continuous edge seaming, and balanced strength with respect to loading. The panel assembly has continuous seam structure (54) with abutting inclined side sections (41, 47) and centered interlocking lateral flange portions (46, 53). The forming apparatus changes straight panels to curved panels and is characterized by separate, alternately operable, sidewall portion and intermediate wall portion indenting drives each having alternate idle and drive modes of operation.

11 Claims, 15 Drawing Figures

7
9
8
61
66
64
65
64a
65a
95
93
81
88
103
104
113
114
83
109
67a
68a
111
57
56
71
69
67
72
68
121
127
124
126
165
164
128
151
159
162
160
161
155
156
157
163
158

121
125
126
124
12
57
128
131
122
129
81
82
58
27
26

PANEL FORMING APPARATUS

TECHNICAL FIELD

This invention relates to a novel and improved panel and panel assembly for use in building-type structures and to novel panel-forming apparatus.

BACKGROUND ART

In prior U.S. Pat. Nos. 3,842,647, 3,902,288 and 3,967,430 of the same inventor as the present invention, there are disclosed a shaped panel characterized by parallel sidewall portions that are perpendicular to an intermediate wall portion and a flange that extends directly laterally out from the upper extremities of the sidewall portions so that assembled panels have sidewall portions that fit flush against one another.

DISCLOSURE OF INVENTION

A relatively wide panel and an assembly of the panels are disclosed which are suitable for forming the roof, sidewalls and end walls of a self-supporting building-type structure. The panel has an intermediate wall portion, a pair of opposed, upwardly diverging, inclined sidewall portions, and a pair of wing portions of substantial lateral extent in relation to the intermediate wall portion, together with male and female edge fastening means that project up from the wing portions. Each wing portion and associated edge fastening means has a dimension related to the dimension of the intermediate wall portion to provide a balanced structure that has substantially the same resistance to both compression and tension loading forces when two of the panels are connected side by side. The edge fastening means of a pair of adjacent panels have inclined side sections to locate the edge fastening means above and substantially centered between the edges of adjacent wing portions which are connected along a continuous seam structure. Forming apparatus for changing a straight panel to a curved panel is arranged for forming transverse indentations in the intermediate wall portion and each of the sidewall portions. The forming apparatus includes separate, alternately operable pairs of indenting dies, each with a hydraulic drive using a hydraulic control system with one idling while the other is being driven.

BRIEF DESCRIPTION OF DRAWINGS

The details of this invention will be described in connection with the accompanying drawings, in which.

DETAILED DESCRIPTION

Figure 1:
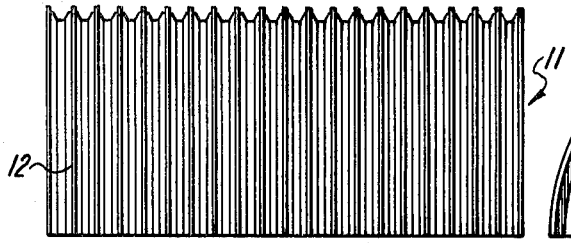
FIG. 1 is a side elevation view of a self-supporting building having an assembly of interconnected panels embodying features of the present invention.
Figure 2:
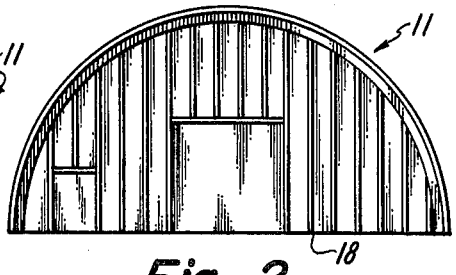
FIG. 2 is an end elevation view of the building shown in FIG. 1.

Referring now to the drawings, there is shown in FIGS. 1 and 2 a self-supported or free-standing building 11 comprised of an assembly of curved panels 12 forming both a roof and opposed sidewalls of the building, and an assembly of straight panels 18 forming the end walls of the building.

The straight panel 18 preferably is produced by a roll-forming machine from a strip of a flat sheet of stock material of sheet metal or the like and may utilize the method and machine disclosed in U.S. Pat. No. 3,529,461. The panel 18 shown has a lower intermediate wall portion 25, a pair of opposed, upwardly, diverging, inclined sidewall portions 26 and 27, and a pair of upper, laterally extending wing portions 28 and 29. Wing portion 28 has a raised male edge fastening means 31 and wing portion 29 has a raised female edge fastening means 32.

The sidewall portions 26 and 27 extend laterally out from the lateral extremities or opposite side edges of the intermediate wall portion 25 and, more specifically, are turned upwardly from the plane of the intermediate wall portion through a selected acute angle. This angle is greater than 45°, and preferably between about 55° and 60°, so as to be closer to a plane perpendicular to the intermediate wall portion, or more upright than horizontal, to increase the overall width of the panel as compared to panels that have sidewall portions perpendicular to the intermediate wall portion.

Figure 3:
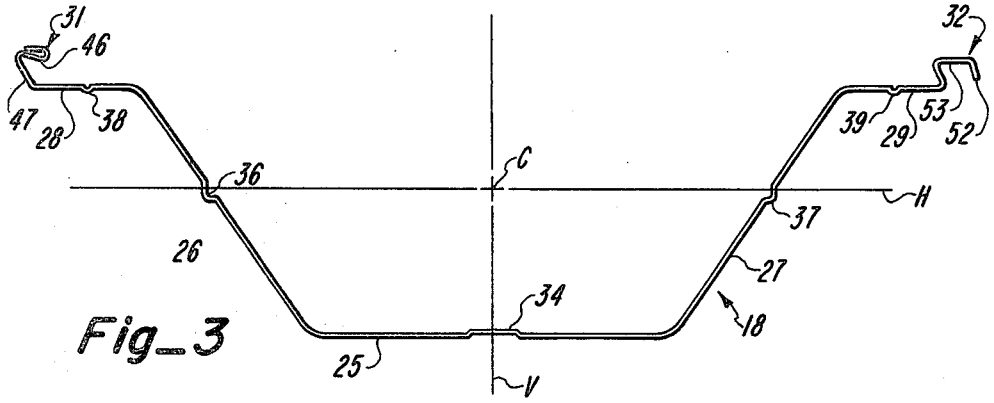
FIG. 3 is a transverse cross-sectional view of a straight panel embodying features of the present invention.

For reference purposes, in FIG. 3 a vertical median line for the panel is designated V, a horizontal median line is designated H, and these lines intersect at the geometric center for the panel which is designated C. In describing the specific embodiment the terms "upward" and "downward" refer to the illustrated embodiment in its normal position of use and the terms "inward" and "outward" refer to directions toward and away from its geometric center.

The intermediate wall portion shown is substantially flat and has a longitudinally extending groove 34 centered on the vertical median line V of the panel. Sidewall portion 26 has a longitudinally extending groove 36 and sidewall portion 27 has a longitudinally extending groove 37, grooves 36 and 37 being located approximately at the horizontal median line H for the panel. Wing portion 28 has a longitudinal groove 38 and wing portion 29 has a longitudinal groove 39, each located at approximately the middle of the associated wing portion. These grooves are optional but in practice were found to provide additional panel strength, greater rigidity and greater durability in the panel.

Figure 5:
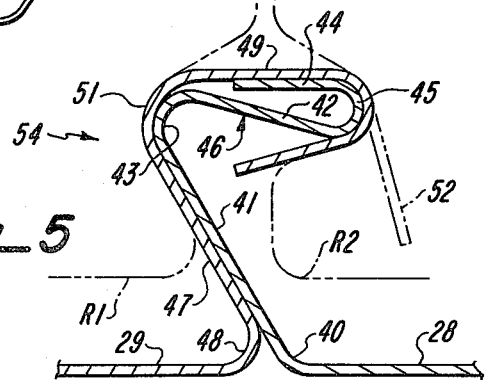
FIG. 5 is an enlarged transverse cross-sectional view of the continuous seam structure shown in FIG. 4.

Referring now to FIG. 5, the raised male edge fastening means 31 shown has an outwardly inclined side section 41 extending laterally out from a lateral extremity or side edge of wing portion 28 and, more specifically, turned upwardly from the plane of wing portion 28 at a bend 40 through an acute angle between about 55° and 60°, together with a lateral flange portion 46. The side section 41 has a length related to the thickness of the seaming rollers R1 and R2, described hereinafter, that permits a portion of the roller R2 to fit between the wing portion 28 and the lateral flange portion 46.

An inturned lateral flange section 42 extends laterally in and at a slight downward incline toward the center of the panel, around through a bend 43 of about 125° from the plane of section 41, along a terminal outturned lateral flange section 44 looped back at a bend 45 of about 180°, and over section 42 which is parallel to wing portion 28 to provide the male lateral flange portion 46 of double thickness, that is substantially parallel to and substantially spaced above the wing portion 28, with a smooth surface along the inside bend 45. This incline in side section 41 locates the male lateral flange portion 46 in a substantially centered position in relation to the lateral extremity of the associated wing portion 28. The inclined side section 41 has enough height to permit the seaming roller R2 to fit between the lateral flange and the associated wing portion.

The female edge fastening means 32 has an inwardly inclined side section 47 extending laterally in from a lateral extremity of wing portion 29 toward the center of the panel. Inclined side section 47 is turned upwardly from the plane of wing portion 29 through a bend 48 at an angle between about 120° to 125° so that inclined side sections 41 and 47 of adjacent panels are parallel to one another and section 41 overlaps section 47 of the adjacent panel. Inclined side section 47 therefore also has an incline and length selected in relation to the thickness of the seaming roller R1 to permit that roller to engage and track on section 47.

A female lateral flange section 49 extends laterally out from the upper end of inclined side section 47 through a bend 51 of about 120°–125° to be back parallel to wing portion 29, and a terminal flange section 52 is turned through a bend of about 60°–80° from the plane of section 49 to provide a female lateral flange portion in the form of an open inverted channel structure with a receiving opening wider than the width of the male edge fastening portion 46 of the adjacent panel which is directly inserted thereinto. A feature of the edge fastening means shown is that it is not necessary to rotate the panel about its axis to insert the male lateral flange portion 46 into the female lateral flange portion 53.

The panel 18 above described has certain dimensional relationships which provide substantially the same structural strength above and below the horizontal median line H for the panel and because of these relationships the panel is herein referred to as a "balanced" or "substantially balanced" panel. In particular, the dimension of the male edge fastening means 31 is substantially the same as that of the female edge fastening means 32, the dimension of the wing portions 28 and 29 is substantially the same, and the dimension of each edge fastening means and associated wing portion is substantially the same as one-half of the dimension of the intermediate wall portion 25 so as to provide substantially the same strength above and below the horizontal median line H for the panel.

The dimension of each wing portion is substantial in relation to the dimension of the intermediate wall portion 25. More specifically, the dimension of each wing portion is greater than one-half the half-width or greater than one-fourth the dimension of the intermediate wall portion 25.

These size or dimension relationships are significant when the panel is under load and the portion of the panel above the horizontal median line is under compression and the portion of the panel below the horizontal median line is under tension. Since the material dimensions of the panel above and below the horizontal median line are substantially the same, there is substantially the same resistance to compression and tension loading forces and hence the panel may be said to be a balanced structure. Moreover, the dimension of the male and female edge fastening means is the same and their location with respect to the vertical median line is substantially the same to provide a symmetrical structure with respect to vertical median line V.

The panel 18 shown typically is shaped from a roller strip of sheet metal of about 22 gauge, preferably prefinished or galvanized steel. This strip is formed into the shaped panel shown by being passed through a continuously operable roll-forming machine of the general type disclosed in U.S. Pat. No. 3,529,461.

By way of illustration and not by way of limitation, a typical wide panel as above described has the following dimensions:

Width of sheet stock: 36 inches
Intermediate wall portion: 8 inches
Wing portion: 3 inches
Depth of corrugations: ½ to ⅛ inch
Width of panel: 24 inches
Depth of panel including seaming edges: 8 inches In assembling two of the above described panels together, the male lateral flange portion 46 of one panel is inserted into the female lateral flange portion 53 of the other panel, which can be done without rotating the panel about its axis. A seaming device is preferably used to turn the terminal flange section 52 from the open position shown in FIG. 3 to a closed position under a portion of the underside of the lateral flange section 42 of the adjacent panel to form a continuous seam structure 54. The seam structure 54 of the assembly is seen to be centered approximately at the side edges or lateral extremities of the abutting side wing portions of adjacent panels.

The terminal flange section 52 is shown to be folded back through an angle of between about 90° and 120° to a position underlying the male flange section 42 and may extend down at an angle of about 15° to the horizontal or folded back to be substantially horizontal, depending on how tight a seam structure is required.

The outline of two seaming rollers R1 and R2 suitable for this purpose is indicated in dashed lines, as above discussed. The general operation of a seamer that travels along a panel flange and forms a seam is disclosed in U.S. Pat. No. 3,875,642, and a specific seamer suitable for forming the seam of these panels is disclosed in my copending application entitled "Panel Seaming Machine."

Figure 4:
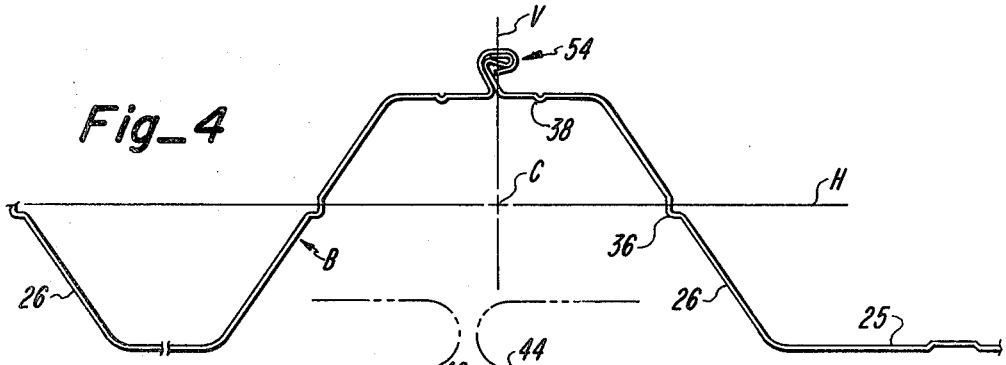
FIG. 4 is a transverse cross-sectional view of an assembly of two of the panels of FIG. 3 connected side by side at continuous seam structure.

When two of the panels are connected side by side as shown in FIGS. 4 and 5 with the male and female fastening flanges connected, there are provided two substantially symmetrical half-section shapes alternately above and below the horizontal median line H for the assembly. The vertical median line that passes through the center of the panel assembly shown in FIG. 5 is again designated V. Under load the portion of the assembly above the horizontal median line H is under compression and the portion of the assembly below the horizontal median line H is under tension.

Referring now to FIGS. 6–15, there are shown panel forming apparatus and the resulting curved panel 12 produced by the panel forming apparatus, the curved panel 12 having longitudinally spaced transverse indentations 57 in the intermediate wall portion 25 and longitudinally spaced, tapered, transverse indentations 58 in each of the inclined sidewall portions 26 and 27. The tapered indentations 58 are wider at the bottom and reach an apex at the top. A preferred taper for indentations 58 is about one degree on each side of the plane of the panel or a total taper of two degrees, as seen in the sectional view in FIG. 12.

The panel forming apparatus shown includes a skeletal, rectangular, support frame having laterally spaced upper side members 61 and laterally spaced lower side members 62, together with upright connecting members 63 connected on both sides at the ends and at spaced intervals along the side members to provide an open box-shaped frame configuration.

Beginning at the infeed end, there are provided two guide assemblies at spaced positions along a preselected straight line course of travel for the panel. A first guide assembly includes an upper roller set comprising an upper roller 64 and a lower guide roller 65 mounted on an upper support plate 66, together with a lower roller set comprising an upper guide roller 67 and two lower guide rollers 68 and 69 spaced along the apparatus and mounted on a movable lower support member 71. The upper roller 64 has a V-shaped peripheral groove and the lower roller 65 has a complementary V-shaped periphery. These rollers are tilted in at an angle of about 20° to the vertical and they engage the inturned inclined side section and an outer portion of the associated wing portion of one side of the flange on the panel.

The upper roller 67 is arranged to rotate about a horizontal axis and has a smooth peripheral surface. Each of the lower rollers 68 and 69 has an asymmetrical groove in its periphery on which the raised lateral flange portion of the panel, turned on its side, will rest. The upper roller 67 engages the inside bend of the fastening flange structure and the inclined section of the panel rides in the asymmetrical groove. The support member 71 is adjustable up and down by a threaded bolt-nut arrangement 72 for a prealinement adjustment for the panel.

The second guide assembly, located downstream of the first, includes a set of one upper and two lower guide rollers **64*a* and 65*a* similar to the upper rollers 64 and 65 above described and in a straight line therewith and a set of one upper guide roller 67*a* and one lower guide roller 68*a* similar to the rollers 67 and 68** in the first guide roller arrangement above described and in alinement therewith. This guide arrangement supports and guides the incoming panel and directs it into the pairs of wall-indenting dies hereinafter described. These guide assemblies minimize abrasion of the panel and provide for both a vertical and a lateral position adjustment.

The sidewall indenting assembly is mounted inside the support frame and includes a first pair of wall-indenting dies 81 and 82 that form tapered indentations 58 in sidewall portion 27 of the panel and a second pair of wall-indenting dies 83 and 84 similar to pair 81 and 82 that form tapered indentations 58 in inclined sidewall portion 26 of the panel. The first pair of wall-indenting dies is disposed at an incline so as to support the panel on its side with the intermediate wall portion 25 in a vertically disposed position.

Each of the wall-indenting dies 81, 82, 83 and 84 is tapered or in the general shape of a truncated cone and, more specifically, the outer die of each set is wider at the top and narrower at the bottom with respect to the top and bottom of the sidewall portion of the panel while the inner die is the reverse, narrower at the top and wider at the bottom with respect to the top and bottom of the sidewall portion of the panel to provide the tapered indentations 58 in the sidewall portions of the panel as above described.

Figures 8, 9, 10, 14:
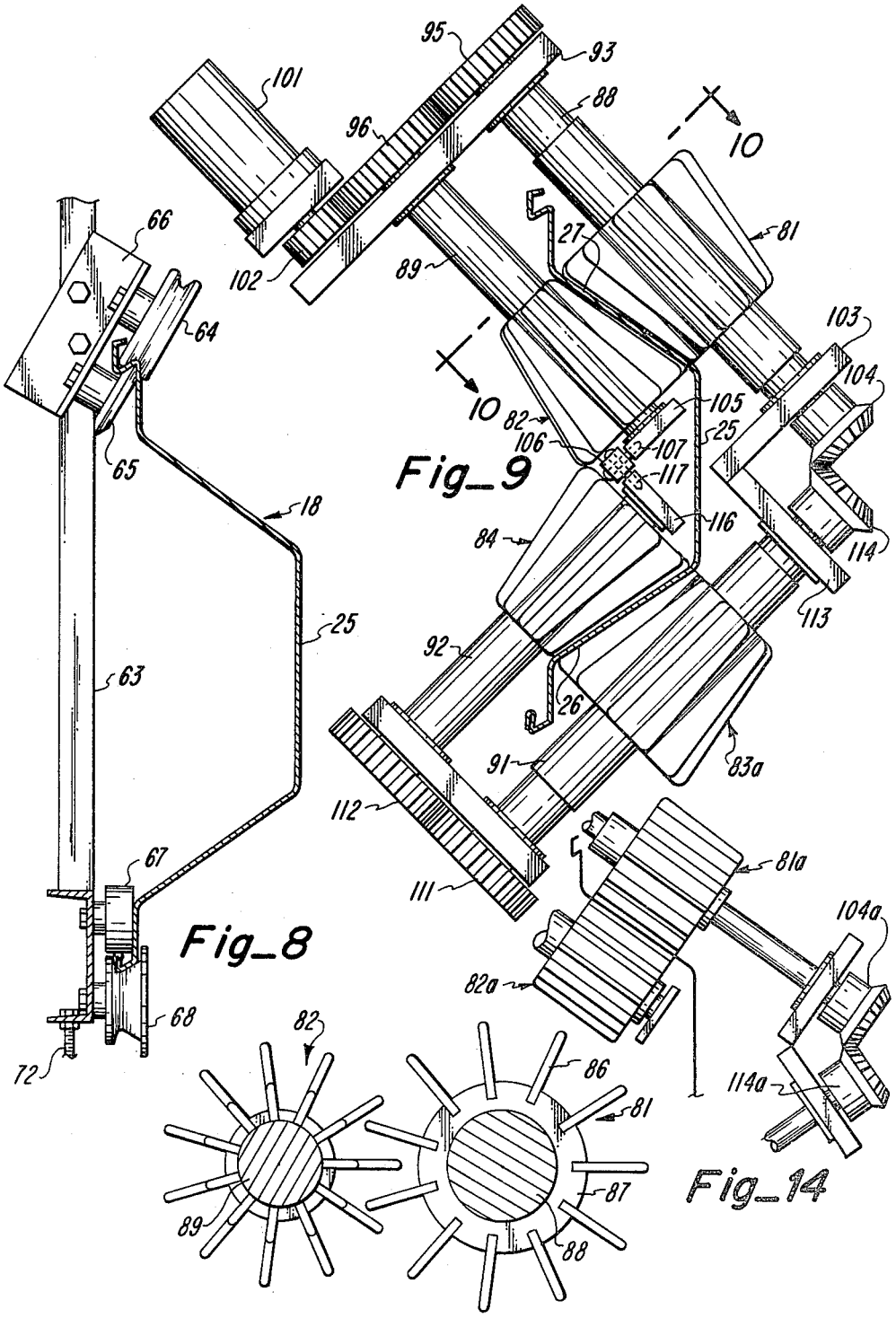
FIG. 8 is an end elevation view of the entry guide portion of the apparatus shown in FIG. 6.
FIG. 9 is an end elevation view of the side-wall indenting rollers shown in FIG. 6.
FIG. 10 is a sectional view taken along lines 10—10 of FIG. 9.
FIG. 14 is an end elevation view of an alternate set of wall-indenting rollers.
Figures 11, 12, 13:
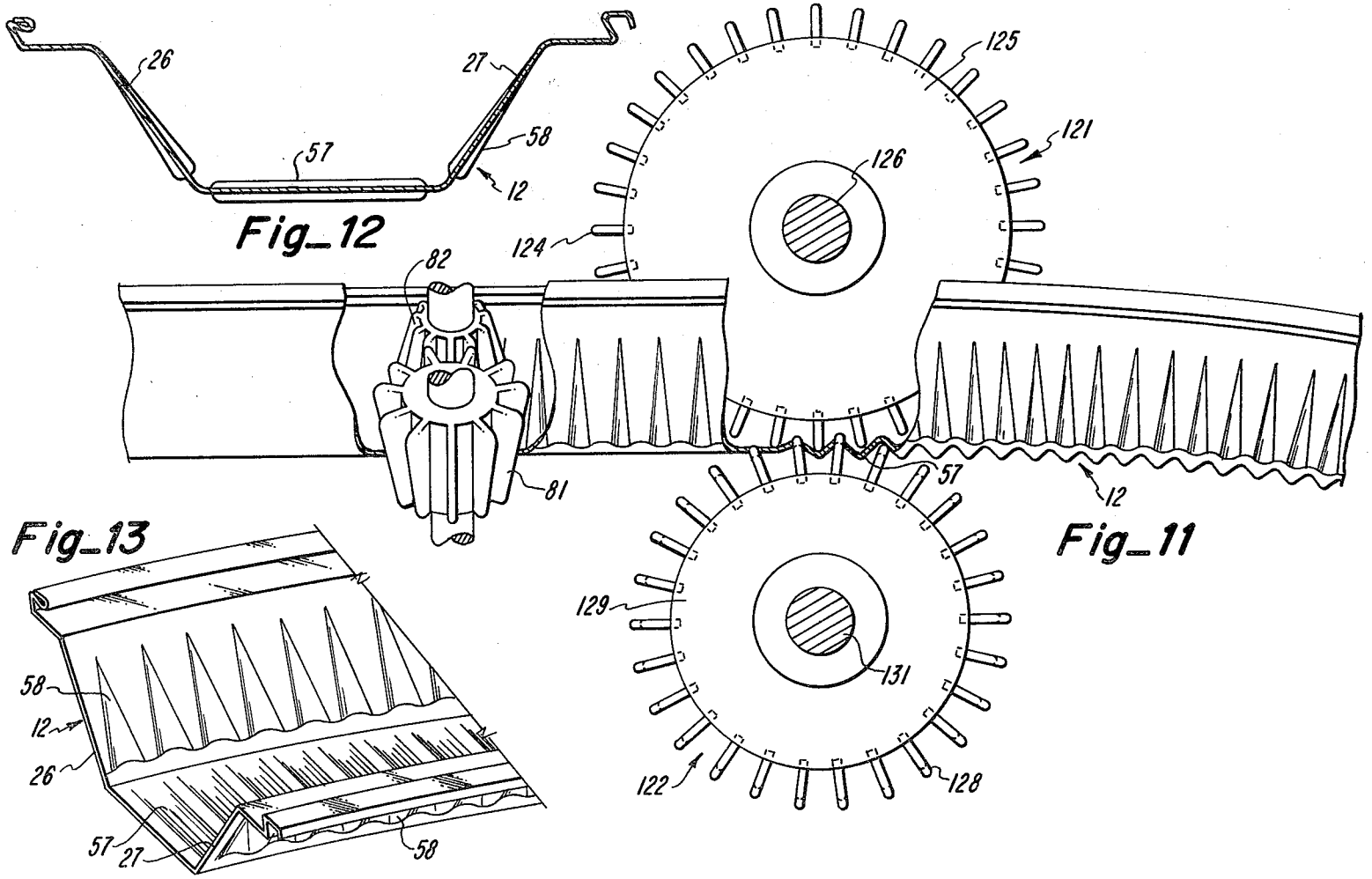
FIG. 11 is a top plan view of the wall-indenting rollers.
FIG. 12 is a sectional view of the curved panel.
FIG. 13 is a perspective view of a segment of a curved panel.

Each die is of a similar construction and, with reference to die 81, this die, as shown in FIG. 10, has a plurality of circumferentially spaced and radially extending die blades 86 mounted in a hub 87 which in turn is carried by a support shaft 88. In turn, die 82 has a support shaft 89, die 83 has a support shaft 91, and die 84 has a support shaft 92.

The upper ends of the shafts 88 and 89 are journaled in suitable associated bearings in a support plate 93 and gears 95 and 96 are mounted on the upper ends of shafts 88 and 89, respectively, and mesh with one another. Drive motor 101 for the wall-indenting dies 81, 82, 83 and 84 has a gear 102 on its output shaft that in turn meshes with gear 96. When the motor 101 rotates, gears 95 and 96 and associated dies 81 and 82 are driven at the same speed in opposite directions. When the motor 101 is not rotated, the dies 81 and 82 rotate freely in an idle mode of operation.

The opposite end of shaft 88 is journaled in a bearing in a support plate 103 and carries a right-angle bevel gear 104 on its lower end. The lower end of the shaft 89 is journaled in a bearing in a support plate 105 which in turn is carried by an adjustable support in the form of a stationary block 106 having a thread screw 107. This arrangement enables the inner die 82 to be adjustably moved toward or away from outer die 81 to adjust the depth of the corrugations or indentations in the sidewall portions of the panel.

The second pair of wall-indenting dies 83 and 84 is similar in construction to the upper pair above described and is arranged at right angles thereto. The outer die 83 is wider at that portion that engages the upper portion of the inclined sidewall portion of the panel and the inner die 84 is narrower at the end adjacent to the wider end of die 83.

The support shafts 91 and 92 have adjacent ends journaled in bearings in a support plate 109, together with meshing gears 111 and 112 on their adjacent ends. The opposite end of shaft 91 is journaled in bearings in a support plate 113 with a right-angle bevel gear 114 on one end that meshes with bevel gear 104 above described. Shaft 92 has the end opposite gear 112 journaled in a bearing in a support plate 116 which in turn is carried by stationary block 106 and has an adjustment screw 117 to enable die 84 to be moved toward and away from die 83 to adjust the depth of the indentations in the sidewall portions of the panel.

In summary, the transmission of power from motor 101 is first through gears 102, 96 and 95 and then through the bevel gear 103 to bevel gear 114 and via shaft 91 to gears 111 and 112 and finally to shaft 92, so that when the motor 101 is actuated all of the wall-indenting dies 81, 82, 83 and 84 are rotated at synchronized speeds.

An alternative form of dies and power train for making the indentations in the sidewall portions shown in FIG. 14 has dies 81*a* and 81*b* with less taper and bevel gears 104*a* and 114*a* less than right-angle gears.

The wall-indenting die assembly for the intermediate wall portion includes a left side indenting die 121 and a right side indenting die 122 as viewed from the feed end. Each of these dies is similar in construction. Die 121 has a plurality of circumferentially spaced, at equal angles, and radially extending die blades 124 mounted on a hub 125 on a support shaft 126 which in turn is journaled in a top bearing 127 and a bottom bearing 128, making die 121 suitable for free rotation about its axis. Right side die 122 has die blades 128 mounted on a hub 129 on a shaft 131 that rotates freely in a top bearing 132 and a bottom bearing 133. A preferred orientation is to have the die shafts disposed upright.

The die blades 124 of left side die 121 have a generally cylindrical or roller-like profile with rounded corners and the opposite die blades 128 of die 122 have raised portions 135 at the corners that serve to bring the indentation around the corner of the panel and establish a corner radius in each indentation in the panel.

The left side die 121 has its top bearing 127 mounted on a slide plate 141 carried by a slotted stationary base plate 143 on a top cross member 144. The side edges of plate 141 are beveled to slide in and be retained by a pair of complementary beveled slot surfaces in base plate 143.

The slide plate 141 is moved by the use of an internally threaded block 145 affixed to slide plate 141 and a screw 146 that threads therein. The screw is threaded via a gear box 147 and handle 148. A similar drive is provided for moving the bottom bearing 128 that is operated by moving a handle 149. The lower slotted stationary base plate 143 for slide plate 141 is mounted on a lower cross member 151. With this drive arrangement, upon the movement of handles 148 and 149 the die 121 is moved toward and away from the right side die 122 to change the depth of the indentations in the intermediate wall of the panel and thereby the degree of arch in the panel. It will be observed that each of the top and bottom ends of the shaft 126 for the left side die 121 is adjustable movable independently of the other.

Figure 6:
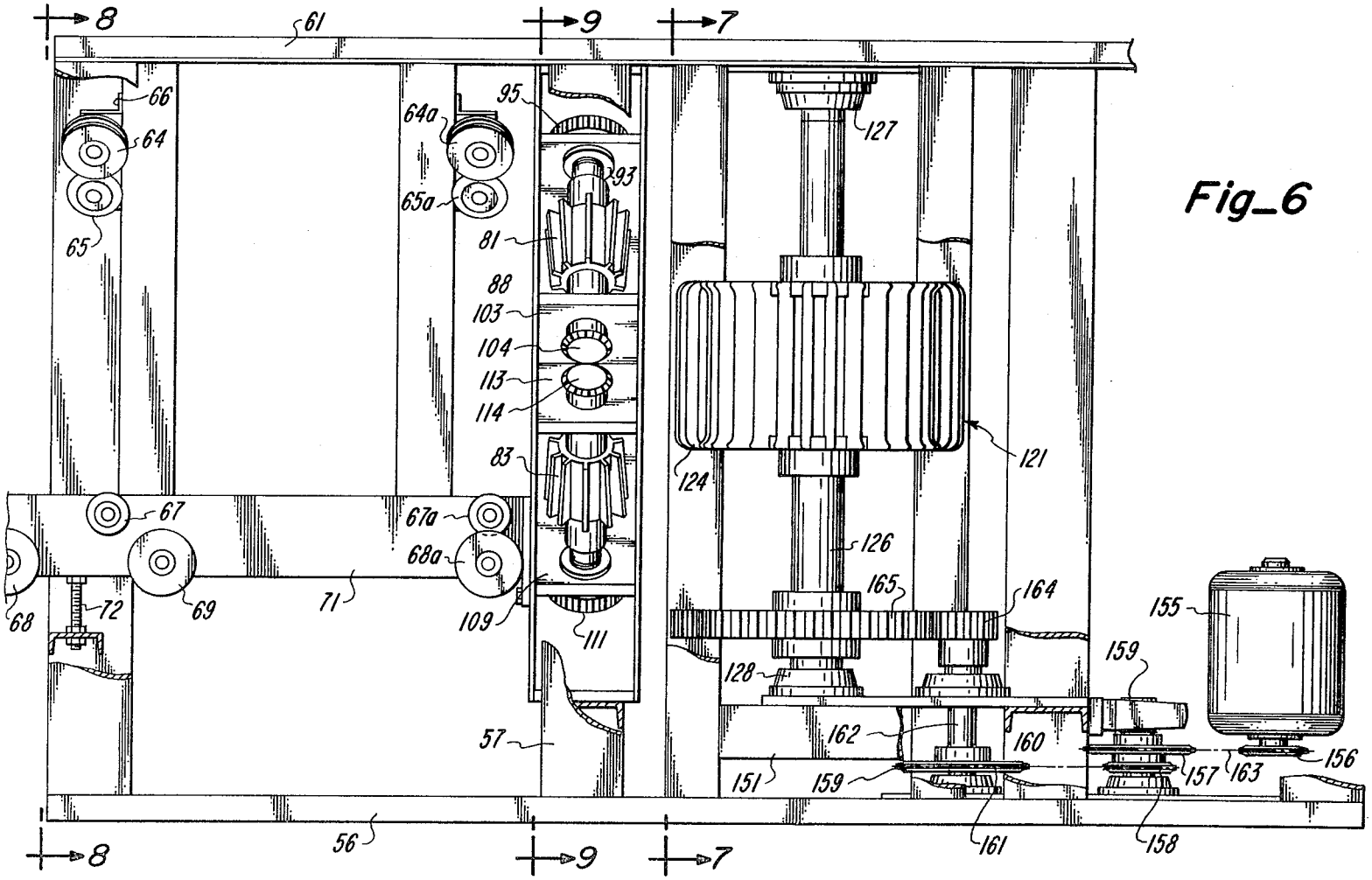
FIG. 6 is a side elevation view of forming apparatus embodying features of the present invention with portions broken away to show interior parts.
Figure 7:
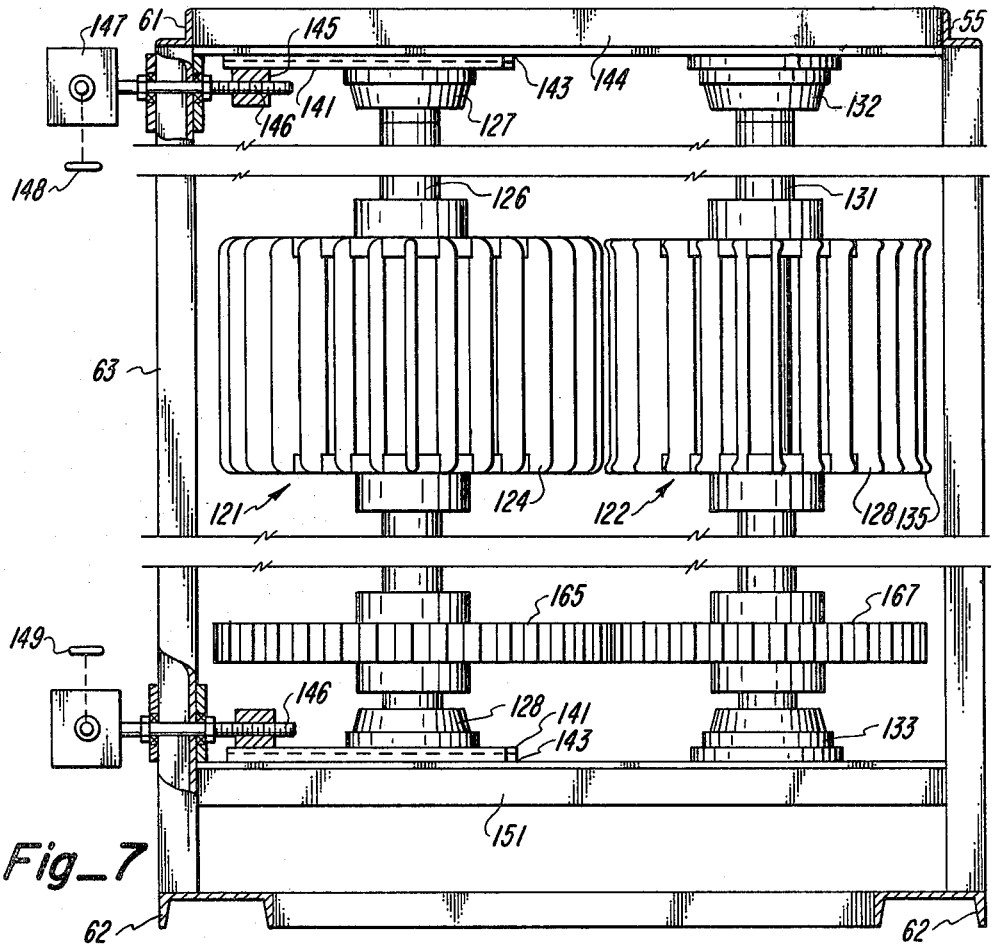
FIG. 7 is an end elevation view of the intermediate panel indenting rollers.

The hydraulic motor 155 for driving the wall-indenting dies 121 and 122 is shown in FIG. 6 as supported by the frame. The power transmission train includes a sprocket 156 on the output shaft of the motor 155, a first pair of intermediate sprockets 157 and 158 on a vertical shaft 159, and a second intermediate sprocket 161 on a second vertical shaft 162 with a chain 163 around sprockets 156 and 157 and a chain 160 around sprockets 158 and 161. Shaft 162 has a gear 164 that meshes with a gear 165 on shaft 126 of die 121. Gear 165 meshes with gear 167 on shaft 131 of die 122 (FIG. 7). With this drive arrangement dies 121 and 122 are driven in opposite directions at synchronized speeds when motor 155 is actuated.

Figure 15:
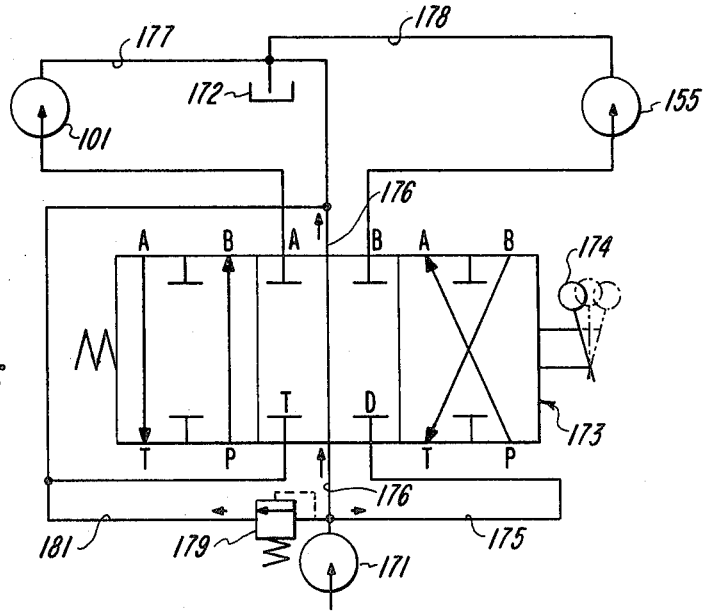
FIG. 15 is a schematic diagram of the drive and control for the drive motors.

The hydraulic drive system for powering hydraulic motors 101 and 155 is shown in FIG. 15. The system includes a conventional hydraulic pump 171, a hydraulic tank 172, and a three-position, open center, detented spool control valve 173 having a control lever 174. An open center core hydraulic line 176 is connected from the output of the pump to the tank via the center core of the valve 173 when the lever 174 is set in the center or middle position and, while in this setting, hydraulic fluid is pumped from the pump 171 directly into the tank via line 176.

When the lever is moved toward the operator the valving arrangement shown to the right side in valve 173 is positioned in the center of the valve so that there is a P-A connection in the valve 173 and fluid is pumped from the pump 171 via a power core line 175 to the wall-indenting motor 101 and back into the tank 172 by return line 177. Additionally, there is a B-T connection in the valve that enables fluid to flow through the wall-indenting motor 155 and back into the tank via a return line 178 in an idle mode of operation for motor 155. "P" is an abbreviation for power and "T" an abbreviation for tank. The designations "A" and "B" are output ports of the valve 173.

When the control lever 174 is pushed away from the operator to the power mode for motor 155, the valving connections shown on the left side of valve 173 are moved to the center of the valve and a P-B connection has the pump 171 pumping via line 175 into the motor 155, and an A-T connection enables fluid to pass through the motor 101 and line 177 in an idle mode of operation for motor 101.

An adjustable pressure relief valve 179 is shown connected between the output of the pump 171 and the tank in a bypass line 181 which will pass fluid directly to the tank 172 in the event the line pressure exceeds a selected pressure such as 1500 psi, as a safety feature.

The direction of rotation of either of the drive motors may be reversed by means of an electric solenoid valve associated with the control valve to reverse fluid flow when in the drive mode for that motor. In a preferred mode the solenoid will be reversed by means of an electric limit switch located at the end of a run-out table for the panel triggered by engagement by the panel.

In a full sequence of operation with a straight panel 12 supported by the guide assembly, when the lever 174 is pulled forward toward the operator the dies 81, 82, 83 and 84 are powered and dies 121 and 122 are in the idle mode. The former grip the panel and push it between dies 121 and 122. The lever 174 is then pushed to the rear and dies 121 and 122 are powered and grip the panel and dies 81, 82, 83 and 84 are in the idle mode and a succession of equally spaced corrugations or indentations is continuously performed in walls of the panel as it is passed therethrough. This arrangement eliminates the need for a cam clutch, etc., and uses an independent direct drive system for the dies associated with the intermediate wall portion and the dies associated with the sidewall portions. The hydraulics affords a relatively simple drive and control system.

Although the present invention has been described with a certain degree of particularity, it is understood that the present disclosure has been made by way of example and that changes in details of structure may be made without departing from the spirit thereof.

What is claimed is:

1. In a panel forming apparatus for producing a curved panel from a straight panel having upwardly inclined sidewall portions extending from an intermediate wall portion, the combination comprising:

first and second pairs of wall-indenting dies spaced from one another to receive therebetween each inclined sidewall portion of a straight panel, said pairs of wall-indenting dies being mounted for free rotation about an axis in an idle mode of operation;

a first drive means to simultaneously rotate said first and second pairs of wall-indenting dies in a power mode of operation;

a third pair of wall-indenting dies located downstream of and in line with said first and second pairs of wall-indenting dies arranged to receive the intermediate wall portion of the panel between each of said third pairs and engage said intermediate wall portion of the panel after it has passed through said first and second pairs of wall-indenting dies, said third pair of wall-indenting dies being mounted for free rotation about an axis in an idle mode of operation;

a second drive means to simultaneously rotate said third pair of wall-indenting dies; and control means for said first and second drive means including an idle setting and a power setting for each of said first and second drive means with a control circuit that alternates the modes for each drive means whereby when the first drive means is idling the second drive means is driving and when the second drive means is idling the first drive means is driving to form said indentations when said panel is passed continuously through said pairs of indenting dies.

2. In a panel forming apparatus as set forth in claim 1 including guide means to guide the incoming straight panel along a predetermined course of travel and into said first and second pairs of wall-indenting dies, said guide means including first and second guide assemblies arranged along a preselected straight-line course of travel, each of said guide assemblies having sets of guide rollers between which edge fastening flanges of the panel are carried to support the panel with its intermediate wall portion upright.

3. In a panel forming apparatus as set forth in claim 2 wherein the lower set of guide rollers of said first assembly is adjustable up and down to aline the panel with said pairs of dies.

4. In a panel forming apparatus as set forth in claim 1 wherein each of said first, second, and third pairs of wall-indenting dies includes a plurality of equally circumferentially spaced and radially extending die blades mounted for rotation with a common hub, the adjacent blades of each pair of dies meshing with one another.

5. In a panel forming apparatus as set forth in claim 4 wherein said die blades are tapered to form tapered indentations that are wider at the bottom and narrower at the top of the sidewall portion of the panel.

6. In a panel forming apparatus as set forth in claim 4 wherein one of the die blades of each pair is mounted on a shaft having a bevel gear, the bevel gears meshing with one another to transmit power from said first pair to said second pair, the end of the shaft opposite the bevel gear having meshing gears for each pair arranged so that each pair rotates at the same speed and in opposite directions.

7. In a panel forming apparatus as set forth in claim 6 wherein one die of each pair is adjustably movable toward and away from the other to change the depth of the indentation in each sidewall portion of the panel.

8. In a panel forming apparatus as set forth in claim 1 wherein one of the dies of said third pair has a generally cylindrical profile with rounded corners and the other die of said third pair has raised corners to establish a corner radius in the sidewall portion of the panel.

9. In a panel forming apparatus as set forth in claim 1 wherein one of said dies of said third pair is adjustably movable toward and away from the other to selected settings to adjust the depth of the indentations in the intermediate wall and thereby the curvature in the panel, each end of said one die being adjustably movable independently of the other.

10. In a panel forming apparatus as set forth in claim 1 wherein each of said dies of said third pair is driven by a common motor at the same speed and in opposite directions.

11. In a panel forming apparatus as set forth in claim 1 wherein said first and second drive means include a first motor coupled via a first power train to the first and second pairs of dies and a second motor coupled via a second power train to said third pair of dies, said motors being hydraulic motors and said control means including a tank, a pump, and a control valve with power fluid flow lines arranged to pump fluid to one motor or the other to drive the motors and idle fluid flow lines to maintain fluid flow when the motor is not pumping.

* * * * *